United States Patent [19]

Tsuchiya et al.

[11] Patent Number: 5,038,747

[45] Date of Patent: Aug. 13, 1991

[54] DESMOKING AND DEODORIZING MEANS FOR GAS GRILL

[75] Inventors: Mitsuo Tsuchiya, Nagoya; Masafumi Matsubara, Owariasahi; Hideo Chikazawa, Kaizu; Kazunori Ueyama, Nagoya, all of Japan

[73] Assignees: Paloma Kogyo Kabushiki Kaisha; Toho Gas Co., Ltd., both of Nagoya, Japan

[21] Appl. No.: 413,170

[22] Filed: Sep. 27, 1989

[51] Int. Cl.[5] ..... A21B 1/00

[52] U.S. Cl. ..... 126/19 R; 126/21 R; 126/273 R

[58] Field of Search ..... 126/41 R, 41 D, 1 E, 126/21 R, 19 R, 273 R, 273 A; 110/212

[56] References Cited

U.S. PATENT DOCUMENTS

| | | | |
|---|---|---|---|
| 2,962,987 | 12/1960 | Hebert et al. | 110/212 |
| 3,043,245 | 7/1962 | Herbert et al. | 110/212 |
| 3,290,483 | 12/1966 | Hurko | 126/19 R |
| 3,327,094 | 6/1967 | Martin et al. | 126/19 R |
| 3,536,457 | 10/1970 | Henderson | 126/21 R |
| 4,944,283 | 7/1990 | Tsuchiya et al. | 126/41 R |

FOREIGN PATENT DOCUMENTS

| | | |
|---|---|---|
| 58-85027 | 5/1983 | Japan . |
| 60-106004 | 7/1985 | Japan . |

*Primary Examiner*—Carroll B. Dority
*Attorney, Agent, or Firm*—Lahive & Cockfield

[57] ABSTRACT

A gas range having at least one stove top surface burner and an interior cooking chamber with a cooking burner includes a chimney extending above the cooking chamber to an exhaust opening at the rear of the top surface. A porous catalyzer plate fits into the exhaust opening and an afterburner is located in the chimney adjacent to the exhaust opening to partially burn and heat exhaust gases. The hot gases then activate the catalyzer to an optimum temperature for effecting their decomposition.

4 Claims, 3 Drawing Sheets

DESMOKING AND DEODORIZING MEANS FOR GAS GRILL

BACKGROUND OF THE INVENTION

1. Field of the Invention

This invention relates to the field of desmoking and deodorizing assemblies for a gas grill.

2. Description of the Prior Art

A conventional desmoking and deodorizing assembly built in a gas range as described above, shown in FIG. 1 and FIG. 2, includes an exhaust opening 2 provided with a porous catalyzer plate 4 disposed at a position just over the combustion chamber 3. clarity, the parts are numbered as follows: 5: front panel, 6: retainer, 7: drawer, 8: water tray, 9: grill, 10: main burner, 11: heat plate, 12: top plate 13: grill drawer.

In this assembly, since a catalyzer plate 4 for desmoking and deodorizing is installed in the exhaust opening 2, the catalyzer plate 4 is heated only by hot exhaust gas going through it. But the heating does not increase up to the optimum temperature for catalyzer activation. Therefore, effective and stable desmoking and deodorizing is not provided. In addition, since the catalyzer plate 4 set in the exhaust opening 2 is located near the main burner, the catalyzer plate 4 may be heavily clogged with boiled mists dropped from a cooking pan. Also, it is difficult in construction for an after burner to be effectively installed just over the combustion chamber 3.

In another known desmoking and deodorizing means, as shown in Japanese published unexamined utility model S60-106004, specifically in an embodiment of FIG. 3 and FIG. 4, an exhaust opening 1 provided with a burner 2 for desmoking and deodorizing is disposed in back on the top of the combustion chamber 3. In these Figures, the parts are identified as follows: A: Gas range, B: Grill, 1: Exhaust opening, 2: Burner for deodorizing.

A burner 2 is installed in an exhaust opening 1 in the back of the top of a combustion chamber 3, which burns the smoke and odor gases included in the exhaust gas. But it achieves insufficient desmoking and deodorizing effect. Furthermore, the flame nozzle of the desmoking and deodorizing burner may be clogged with boiled mists dropped from a cooking pan since the exhaust opening 1 is installed near the main burner.

SUMMARY OF THE INVENTION

An object of the present invention is an improved desmoking and deodorizing assembly.

Another object of the present invention is a means for burning smoke and odor gases to be eliminated.

Another object of the present invention is a means for heating a catalyzer to an optimum temperature to be activated.

Another object of the present invention is a catalyzer plate located in a place where said catalyzer is not clogged.

More specifically, an object of the present invention is the provision of a means for removably disposing a porous catalyzer plate.

Furthermore, an object of the present invention is the provision of a means for miniaturizing a gas range provided with a desmoking and deodorizing assembly.

Briefly, these and other objects of the present invention are realized in a specific illustrative embodiment. that comprises an exhaust opening 40, communicating with a chimney 34 located over a combustion chamber 25, and located at a backside on the top of the gas grill. A porous catalyzer plate 41 is removably set on a rack in said exhaust opening 40. An after burner 46 is disposed in said chimney 34 adjacent to the outlet 47 of the chimney 34. The desmoking and deodorizing is accomplished in the two steps: in the first step, the after burner burns out the exhaust gas including smoke and odor gases to be decomposed into other matter to eliminate smoke and odor, and then, the heat resulting from such burning gases heats the porous catalyzer 41 set in the exhaust opening 40 to the optimum temperature for its activation. In the second step, the heated and activated porous catalyzer 41 absorbes the residual gases going through the exhaust opening 40. In this manner oil and soot which may cause clogging the cells of the catalyzer plate are completely burnt out at the second step, so that stable, durable and effective catalyzing is achieved. This assures that the kitchen will be always maintained in a comfortable condition.

BRIEF DESCRIPTION OF THE DRAWING

A complete understanding of the present invention and of the above and other objects, features and advantages thereof may be gained from a consideration of the following detailed description of a specific illustrative embodiment thereof, presented hereinbelow in connection with the accompanying drawings, in which.

DETAILED DESCRIPTION

Figure 1:
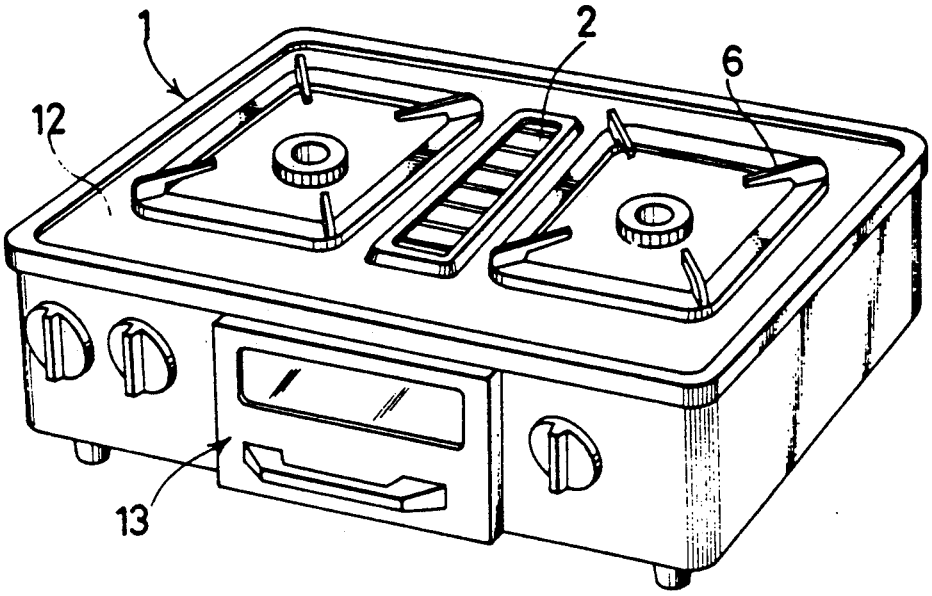
FIG. 1 ( PRIOR ART )
FIG. 1 is a pictorial view of a gas range equipped with a desmoking and deodorizing assembly.
Figure 2:
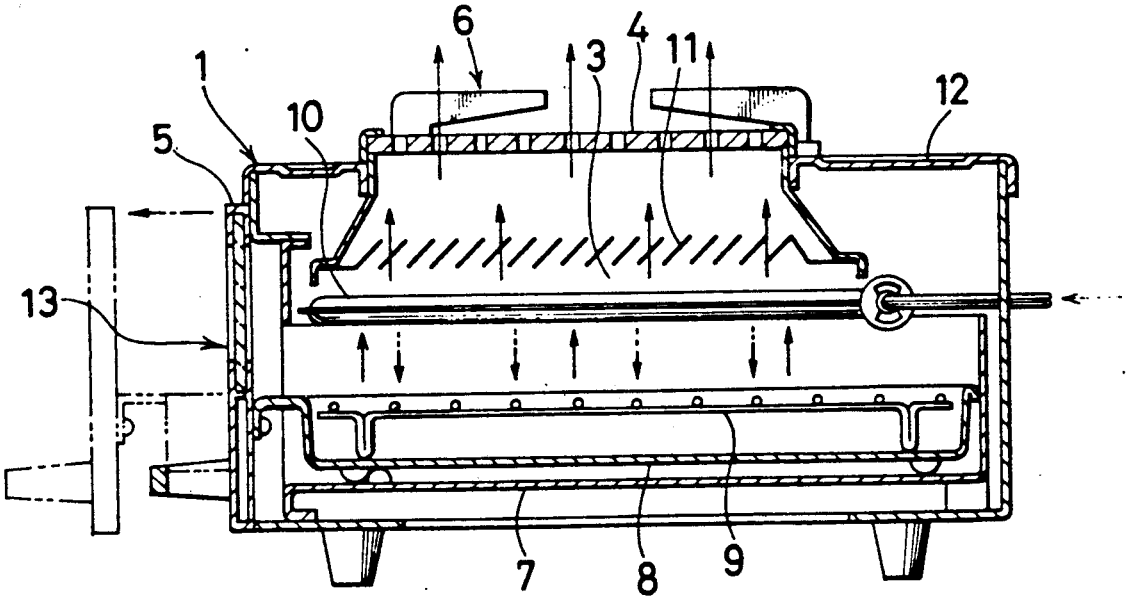
FIG. 2 ( PRIOR ART )
FIG. 2 is a sectional view of the range of FIG. 1.
Figure 3:
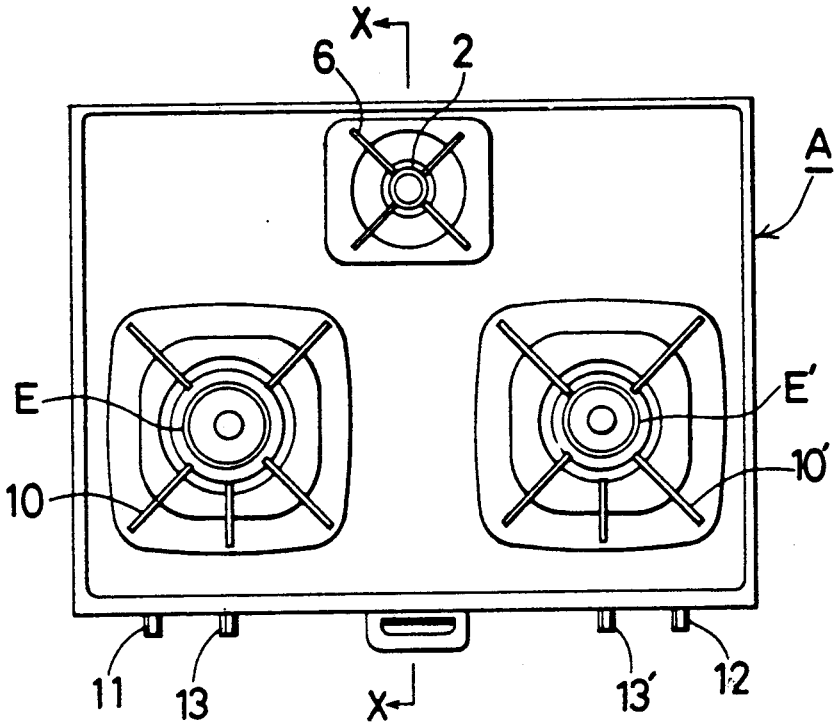
FIG. 3 (PRIOR ART)
FIG. 3 is a plan view of another gas range.
Figure 4:
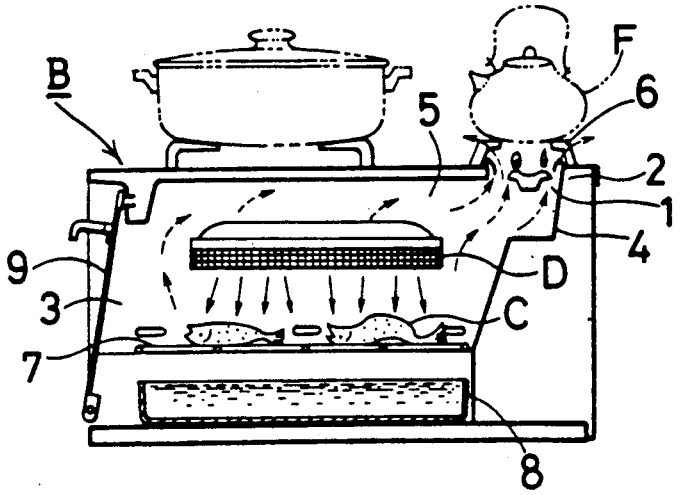
FIG. 4 ( PRIOR ART )
FIG. 4 is a sectional view of the range of FIG. 4.
Figure 5:
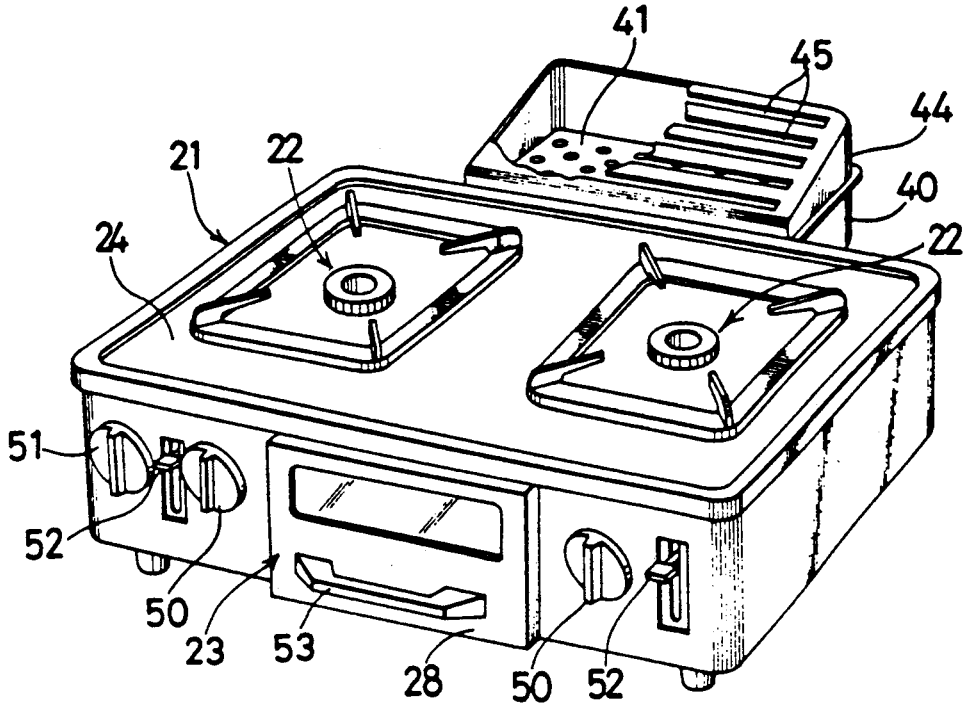
FIG. 5 is a pictorial view of a gas range equipped with a desmoking and deodorizing assembly of the present invention.
Figure 6:
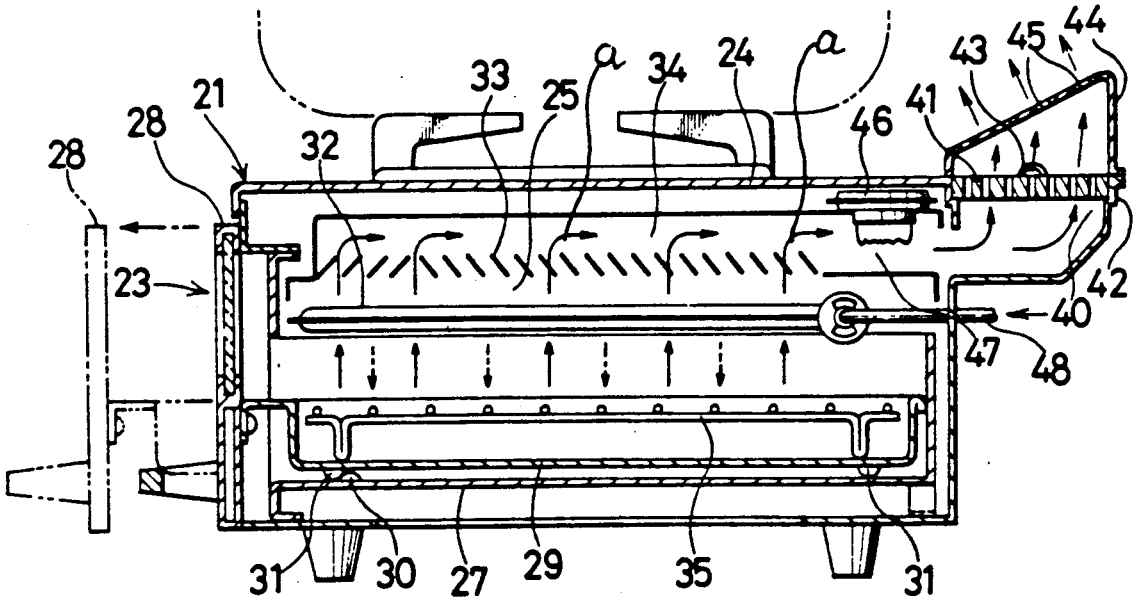
FIG. 6 is a sectional view of the range of FIG. 5.

As illustrated in FIG. 5 and FIG. 6, the invention is embodied in a desmoking and deodorizing assembly to applied to a cooking-use gas range 21 comprising a table top double gas cooking unit, or double stove burners 22, and a grill section 23, disposed under said double burners 22. A grill drawer 23 comprises a double sliding mechanism with a drawer 27 with a front panel 28 slidable into a grill chamber 25, on which a water tray 29 is slidable within a certain span restricted by an alternating set of stoppers 30 and 31. A grill burner 32 and heat plate 33 are provided thereover. In the top of the grill chamber 25, is a chimney 34 in which smoke and ordor are collected from broiling foods such as fish, meat or the like heated by said grill burner 32 and heat plate 33 and then are guided to an exhaust opening 40 described later. The exhaust opening 40, projecting in the back of the gas range 21, communicates with said chimney 34. A desmoking and deodorizing porous catalyzer plate 41 is removably disposed in the exhaust opening 40; that is, the porous catalyzer plate 41 with a handle 43 convenient for handling is put on a support rack 42 provided in the exhaust opening 40. Preferably the mesh of the porous catalyzer 41 is 50–120 cells per square inch. An exhaust opening cover 44 having a porous exhaust holes is positioned in and removable from the exhaust opening. An after burner, disposed in a place adjacent to the outlet 47 of the chimney 34, burns the combustion gas in the chimney 34 to eliminate smoke and odor gases contained therein and the resulting combustion heat contributes to heat said catalyzer to the optimum temperature for activation. The location of the after burner may be in any place that satisfies the above heat requirement, either an upward-mount in a proper place in the chimney 34 or a downward-mount in a place adjacent to the outlet 47 of the chimney 34 in as the above embodiment. The after burner 46 is so installed that the burner 46 can be easily removed just after the removal of the top plate 24, which is convenient for maintenance.

Elements are indentified by the following numerals: in FIG. 5 and FIG. 6; 50: ignition knob for the burner, 51: ignition knob for the grill 23, 52: air adjusting knob, 53: handle for grill 23, 48: gas inlet for grill burner 32.

In the above constitution, smoke and odor gases produced from food such as fish or meat on the broiler 35 in the grill chamber 25 are collected in the chimney 34 together with the combustion exhaust gas (arrow "a" in FIG. 6) from the grill burner 32, which are guided into the exhaust opening 40. Then, the after burner 46 mounted in a downward direction at a place adjacent to the outlet 47, burns these gases to decomposite them into other matter, resulting an elimination of smoke and odor gases. This desmoking and deodorizing is the first process which preriminarily burns out oil and smoke that may cause a clogging in the porous catalyzer plate.

The exhaust gas including smoke and odor gases burnt by the after burner 46 in the first process goes through the porous catalyzer plate 41 and heats the porous catalyzer plate 41 to the optimum temperature of 300°–400° C. to be activated, which results in completely and effectively absorbing the residual smoke and odor gases This is the second process of the desmoking and deodoring sequence. Because from such use of the catalyzer plate, the absorbing efficiency for smoke and odor gases reaches a high level, the catalyzer plate can be smaller in size in comparison with a conventional one. Thus, the overall size of a the gas range provided with the desmoking and deodoring means is minimized.

Furthermore, although the porous catalyzer plate 41 is removably set on the rack 42, it is convenient to handle the porous catalyzer plate 41 with the attached handle 43 when it is cleaned or replaced. For the cell number of the porous catalyzer, 50–120 cells per square inch are recommended to get the highest effective desmoking and deodoring. If the cell count is denser than this, the catalyzer may become clogged such that it is difficult to clean, while, if the cell is less dense, catalyzing is less effective It is to be understood that the invention is not limited in its application to the details of construction and arrangement illustrated in the accompanying drawings, since the invention is capable of other embodiments and of being practiced or carried out in various ways.

What is claimed is:

1. In a gas range having a top cooking surface with at least one stove burner, and an interior cooking chamber with a gas cooking burner, the improved assembly for desmoking and deodorizing fumes from the interior chamber, comprising a chimney located in an upper portion of said chamber and defining a path for exhaust therefrom, said chimney leading to means defining an exhaust opening extending behind the top cooking surface a porous catalyzer plate removably disposed in the means defining an exhaust opening for catalyzing the oxidation of exhaust from the interior chamber, and an afterburner located in the chimney adjacent to the means defining an exhaust opening for partially burning and heating exhaust in the chimney including smoke and odor gases to be decomposed into other matter to eliminate said smoke and odor gases, heat produced thereby heating the catalyzer plate to an optimum temperature for activation.

2. In a gas range having a top cooking surface with at least one stove burner and an interior cooking chamber with a gas cooking burner, the improved assembly of claim 1, further comprising a removable cover that fits over the catalyzer plate, said cover extending upwardly from the means defining an exhaust opening and having a plurality of apertures for passage of decomposed smoke and odor gases therethrough.

3. In a gas range having a top cooking surface with at least one stove burner and an interior cooking chamber with a gas cooking burner, the improved assembly of claim 1, wherein the catalyzer plate drops into the means defining an exhaust opening and is supported on a support surface therein.

4. In a gas range having a top cooking surface with at least one stove burner and an interior cooking chamber with a gas cooking burner, the improved assembly of claim 1, wherein the catalyzer plate has a cell count of between approximately fifty and one hundred twenty cells per square inch.

* * * * *